US011037726B2

(12) United States Patent
Yasuoka et al.

(10) Patent No.: US 11,037,726 B2
(45) Date of Patent: Jun. 15, 2021

(54) METHOD FOR MANUFACTURING COMMON-MODE CHOKE COIL

(71) Applicant: Panasonic Intellectual Property Management Co., Ltd., Osaka (JP)

(72) Inventors: Yuji Yasuoka, Osaka (JP); Tomohiro Fujita, Osaka (JP); Takeyuki Fujii, Osaka (JP); Toru Inoue, Osaka (JP); Chikara Nara, Osaka (JP); Makoto Itou, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 273 days.

(21) Appl. No.: 16/344,355

(22) PCT Filed: Nov. 8, 2017

(86) PCT No.: PCT/JP2017/040176
§ 371 (c)(1),
(2) Date: Apr. 23, 2019

(87) PCT Pub. No.: WO2018/154858
PCT Pub. Date: Aug. 30, 2018

(65) Prior Publication Data

US 2019/0272952 A1 Sep. 5, 2019

(30) Foreign Application Priority Data

Feb. 24, 2017 (JP) ..... JP2017-033085

(51) Int. Cl.
*H01F 7/06* (2006.01)
*H01F 41/06* (2016.01)
(Continued)

(52) U.S. Cl.
CPC ..... *H01F 41/06* (2013.01); *H01F 17/04* (2013.01); *H01F 27/29* (2013.01);
(Continued)

(58) Field of Classification Search
CPC ..... H01F 41/0206; H01F 41/04; H01F 41/06; H01F 2017/0093; H01F 27/29; H01F 17/04
See application file for complete search history.

(56) References Cited

U.S. PATENT DOCUMENTS 6,157,283 A * 12/2000 Tsunemi ..... H01F 27/292 336/192
6,535,095 B2 * 3/2003 Aoki ..... H01F 17/045 336/83
(Continued)

FOREIGN PATENT DOCUMENTS

JP 7-161563 6/1995

OTHER PUBLICATIONS

International Search Report of PCT application No. PCT/JP2017/040176 dated Dec. 12, 2017.

*Primary Examiner* — Paul D Kim
(74) *Attorney, Agent, or Firm* — McDermott Will and Emery LLP

(57) ABSTRACT

A magnetic core includes a winding core and first and second flanges connected to the winding core. First and second terminal electrodes are connected to a lead frame. The first flange is bonded to the first and second terminal electrodes. Third and fourth terminal electrodes are bonded to the second flange. First and second insulation-coated conductive wires are wound about the winding core. The first and second insulation-coated conductive wires are connected to the first and second terminal electrodes and the third and fourth terminal electrodes. The lead frame is bent so as to rotate the magnetic core by 90 degrees with respect
(Continued)

to the lead frame. A magnetic plate is bonded to the magnetic core. The magnetic core is removed from the lead frame by removing the first and second terminal electrodes from the lead frame, thereby providing a common-mode choke coil. The common-mode choke coil having stable electrical performance is produced efficiently by the above method.

9 Claims, 8 Drawing Sheets

(51) Int. Cl.

| | |
|---|---|
| ***H01F 17/04*** | (2006.01) |
| ***H01F 27/29*** | (2006.01) |
| ***H01F 41/02*** | (2006.01) |
| ***H01F 41/04*** | (2006.01) |
| *H01F 17/00* | (2006.01) |

(52) U.S. Cl.
CPC ..... *H01F 41/0206* (2013.01); *H01F 41/04* (2013.01); *H01F 2017/0093* (2013.01)

(56) References Cited

U.S. PATENT DOCUMENTS

| | | | | |
|---|---|---|---|---|
| 7,084,730 | B2 * | 8/2006 | Kitagawa | H01F 27/292 336/200 |
| 8,305,181 | B2 * | 11/2012 | Kitagawa | H01F 27/29 336/192 |
| 10,032,685 | B2 * | 7/2018 | Kanbe | H01F 27/30 |
| 2018/0005751 | A1 * | 1/2018 | Igarashi | H01F 27/2823 |

* cited by examiner

METHOD FOR MANUFACTURING COMMON-MODE CHOKE COIL

CROSS-REFERENCE TO RELATED APPLICATIONS

This application is a U.S. national stage application of the PCT international application No. PCT/JP2017/040176 filed on Nov. 8, 2017, which claims the benefit of foreign priority of Japanese patent application No. 2017-033085 filed on Feb. 24, 2017, the contents all of which are incorporated herein by reference.

TECHNICAL FIELD

The present disclosure relates to a method for manufacturing a common-mode choke coil, including a magnetic core and wire, used in a range of electronic devices.

BACKGROUND ART

A winding-type common-mode choke coil is known to be used for suppressing unwanted radiation noise of power supply lines and common-mode noise of radio frequency signals.

The common-mode choke coil includes a ferrite magnetic core with flanges on both sides of a winding core, a wire formed of multiple insulation-coated conductive wires wound about the winding core of the magnetic core for several to several tens of turns typically by bifilar winding, and a magnetic plate bonded with adhesive to both flanges of the magnetic core. The magnetic plate has almost the same magnetic permeability as the magnetic core. The magnetic core and the magnetic plate are made by baking pressed ferrite powder mixed with binder. Multiple electrodes are formed on at least one flange, and a winding-start end and winding-finish end of the wire are soldered or thermally compressed onto these electrodes to establish conductive connection. This type of common-mode choke coil achieves a predetermined impedance value by setting appropriate number of turns of the wire wound about the winding core of the magnetic core. In this case, the insulation-coated conductive wire needs to be wound about each of the magnetic cores, resulting in poor productivity. In this regard, a proposal is made for winding the insulation-coated conductive wire in the state the magnetic core is bonded to the lead frame.

For example, PTL 1 discloses a conventional method for manufacturing a common-mode choke coil similar to the above common-mode choke coil.

CITATION LIST

Patent Literature

PTL1: Japanese Patent Laid-Open Publication No. 7-161563

SUMMARY

A magnetic core includes a winding core and first and second flanges connected to the winding core. First and second terminal electrodes are connected to a lead frame. The first flange is bonded to the first and second terminal electrodes. Third and fourth terminal electrodes are bonded to the second flange. First and second insulation-coated conductive wires are wound about the winding core. The first and second insulation-coated conductive wires are connected to the first and second terminal electrodes and the third and fourth terminal electrodes. The lead frame is bent so as to rotate the magnetic core by 90 degrees with respect to the lead frame. A magnetic plate is bonded to the magnetic core. The magnetic core is removed from the lead frame by removing the first and second terminal electrodes from the lead frame, thereby providing a common-mode choke coil.

The common-mode choke coil having stable electrical performance is produced efficiently by the above method.

DESCRIPTION OF EMBODIMENTS

Figure 1A:
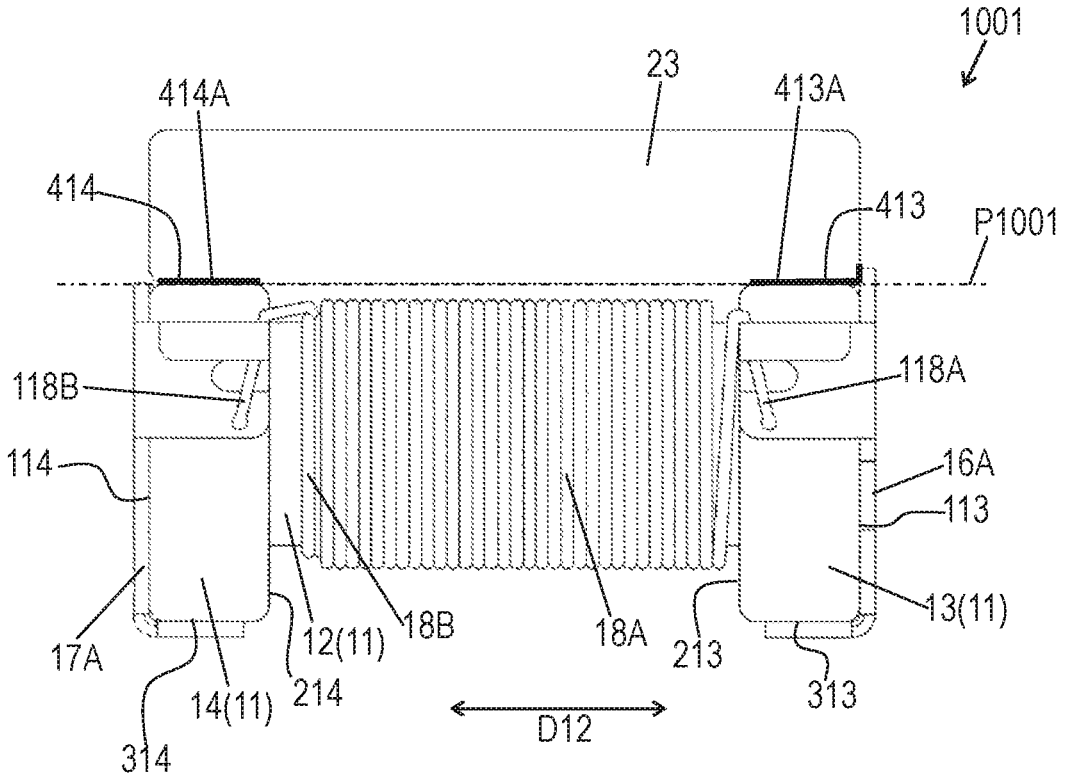
FIG. 1A is a side view of a common-mode choke coil in accordance with an exemplary embodiment.
Figure 1B:
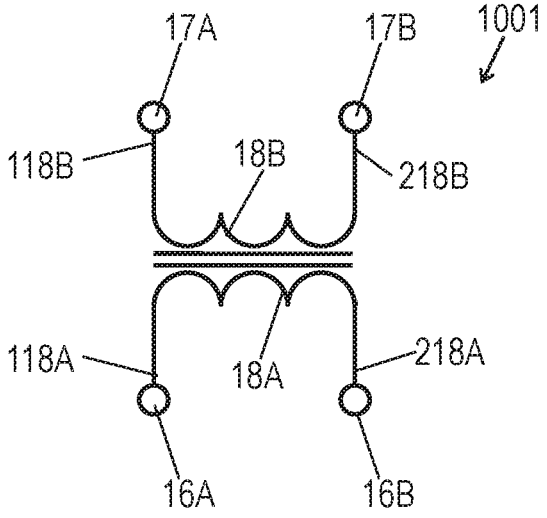
FIG. 1B is a circuit diagram of the common-mode choke coil in accordance with the embodiment.

FIG. 1A is a side view of common-mode choke coil 1001 in accordance with an exemplary embodiment. FIG. 1B is a circuit diagram of common-mode choke coil 1001. Common-mode choke coil 1001 includes magnetic core 11, insulation-coated conductive wires 18A and 18B wound about magnetic core 11, and terminal electrodes 16A, 16B, 17A, and 17B bonded to magnetic core 11. One end 118A of insulation-coated conductive wire 18A is connected to terminal electrode 16A, and another end 218A of insulation-coated conductive wire 18A is connected to terminal electrode 16B. One end 118B of insulation-coated conductive wire 18B is connected to terminal electrode 17A, and another end 218B of insulation coated conductive wire 18B is connected to terminal electrode 17B. Insulation-coated conductive wires 18A and 18B are magnetically coupled to each other.

A method for manufacturing common-mode choke coil 1001 will be described below with reference to drawings.

FIGS. 2 to 10 are perspective views of common-mode choke coil 1001 for illustrating the method of manufacturing common-mode choke coil 1001.

Figure 2:
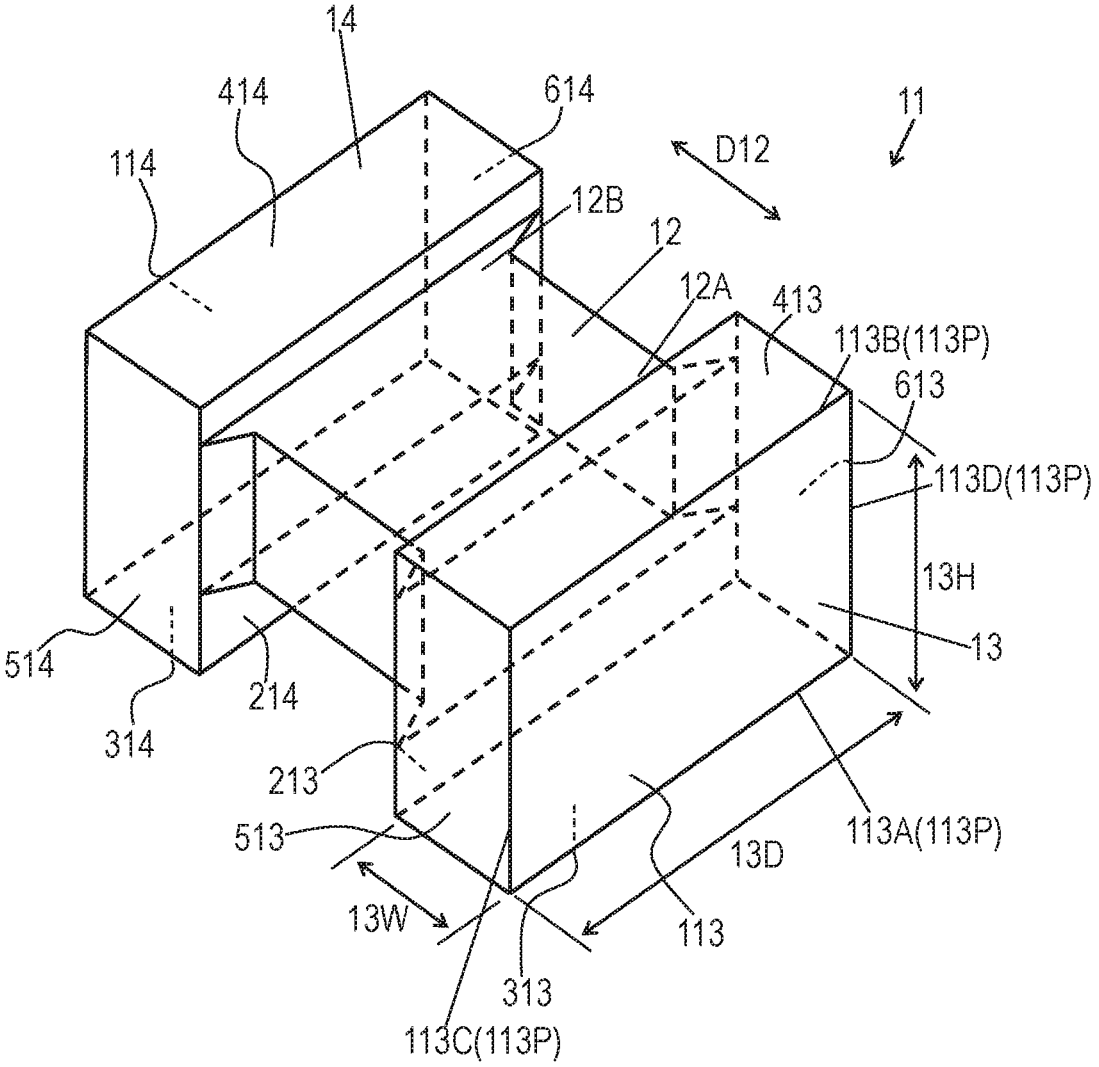
FIG. 2 is a perspective view of a magnetic core of the common-mode choke coil in accordance with the embodiment.

First, magnetic core 11 is prepared. FIG. 2 shows magnetic core 11. Magnetic core 11 includes winding core 12 having ends 12A and 12B opposite to each other in longitudinal direction D12, flange 13 connected to end 12A of winding core 12, and flange 14 connected to end 12B of winding core 12. Width 13W of flanges 13 and 14 in the longitudinal direction is about 3.2 mm Outer dimension 13D of flanges 13 and 14 is about 4.5 mm Height 13H of flanges 13 and 14 is about 2.2 mm Magnetic core 11 is obtained by pressing ferrite powder mixed with binder and then baking the pressed ferrite powder.

Flange 13 has surface 213 connected to winding core 12, surface 113 opposite to surface 213 in longitudinal direction D12, and end surfaces 313, 413, 513, and 613 connected to surfaces 113 and 213. End surfaces 313 and 413 are opposite to each other, and end surfaces 513 and 613 are opposite to each other. Surface 113 has substantially a rectangular shape surrounded by four sides 113A to 113D. Four sides 113A to 113D thus constitute outer peripheral edge 113P of surface 113. End surfaces 313 to 613 are connected to surface 113 at sides 113A to 113D, respectively. Side 113A and 113B are parallel to each other. Sides 113C and 113D are parallel to each other and perpendicular to sides 113A and 113B. Similarly, flange 14 has surface 214 connected to winding core 12, surface 114 opposite to surface 214 in longitudinal direction D12, and end surfaces 314, 414, 514, and 614 connected to surfaces 114 and 214. End surfaces 314 and 414 are opposite to each other, and end surfaces 514 and 614 are opposite to each other.

Figure 3:
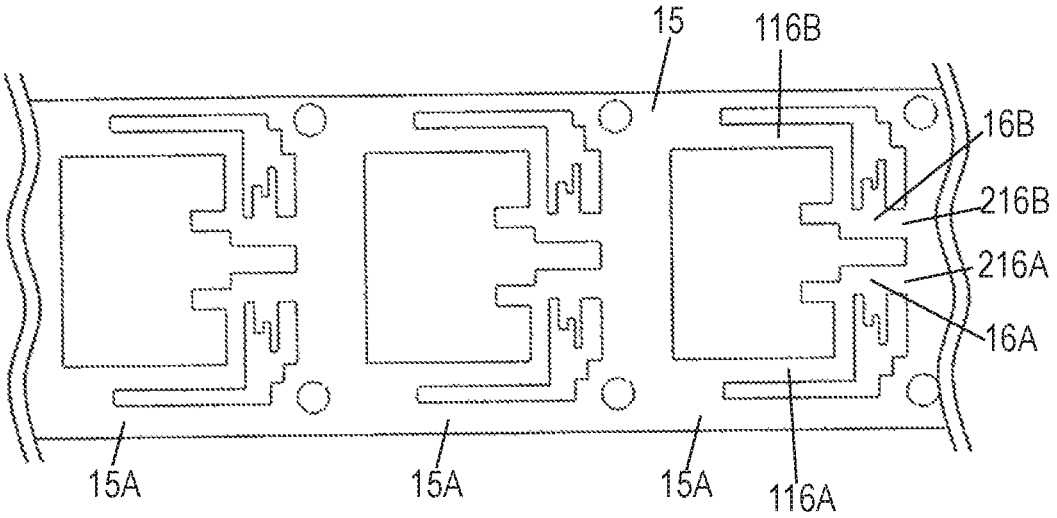
FIG. 3 is a perspective view of the common-mode choke coil in accordance with the embodiment for illustrating a method of manufacturing the common-mode choke coil.

Next, lead frame 15 having a hoop shape shown in FIG. 3 is prepared. Lead frame 15 includes plural frames 15A connected to form the hoop shape. Terminal electrodes 16A and 16B are connected to lead frame 15. More specifically, lead frame 15 further includes portions 116A, 116B, 216A, and 216B. Portions 116A and 216A extend from each frame 15A, and are connected to terminal electrode 16A. Portions 116B and 216B extend from each frame 15A and are connected to terminal electrode 16B. Lead frame 15 to which terminal electrodes 16A and 16B are connected is obtained by punching and bending a metal sheet made of phosphor bronze and having a thickness of about 0.1 mm. Terminal electrodes 16A and 16B are disposed on flanges 13 and 14 of magnetic core 11, respectively. Terminal electrode 16A is connected to lead frame 15 via two portions 116A and 216A, and terminal electrode 16B is connected to lead frame 15 via two portions 116B and 216B.

Figure 4:
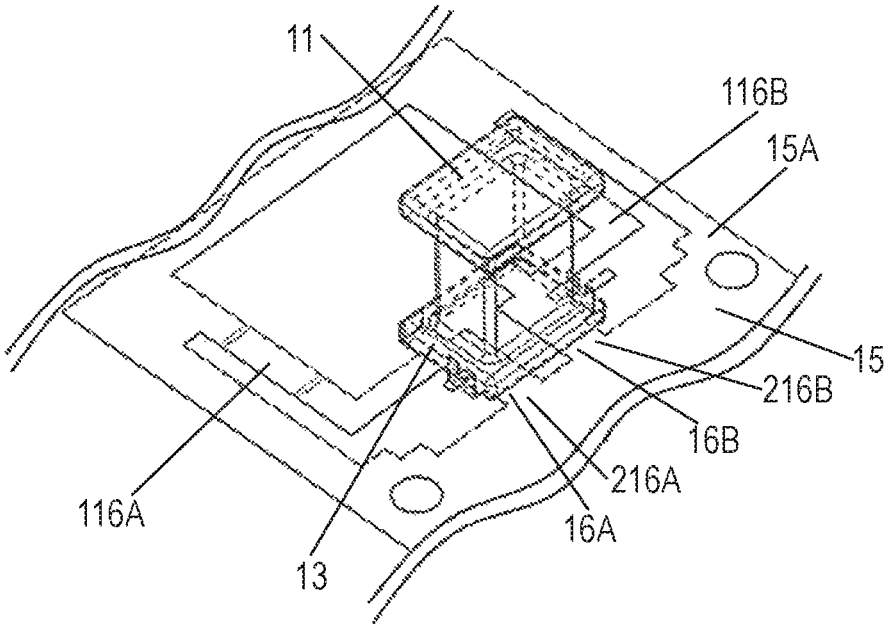
FIG. 4 is a perspective view of the common-mode choke coil in accordance with the embodiment for illustrating the method of manufacturing the common-mode choke coil.

Next, as shown in FIG. 4, adhesive is applied to portions of flange 13 of magnetic core 11 where terminal electrodes 16A and 16B are to be disposed thereon. Magnetic core 11 is placed such that flange 13 of magnetic core 11 is bonded to terminal electrodes 16A and 16B. Magnetic core 11 is tentatively fixed onto lead frame 15 via terminal electrodes 16A and 16B by heating at a temperature of 150° C. for about 1 minute. Magnetic core 11 is thus supported by four portions 116A, 116B, 216A, and 216B of lead frame 15.

Figure 5:
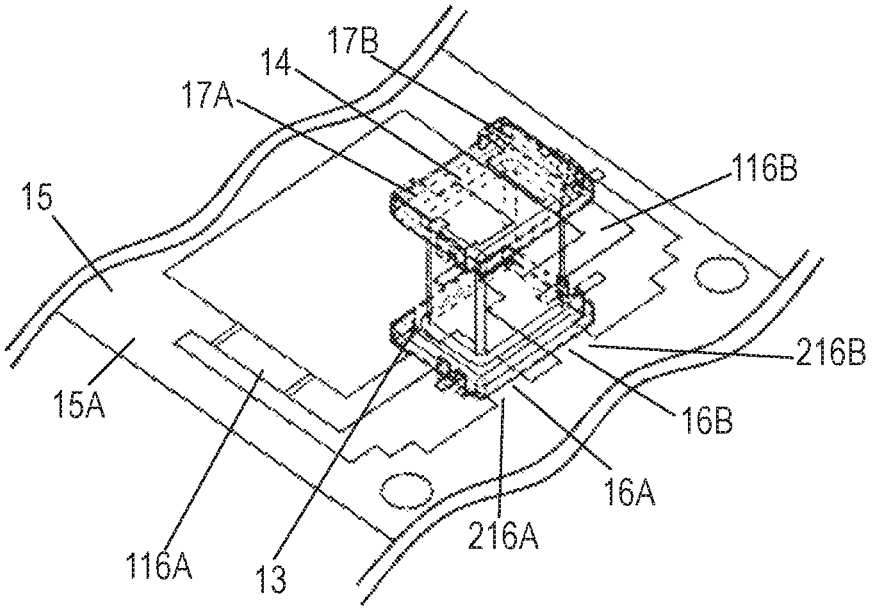
FIG. 5 is a perspective view of the common-mode choke coil in accordance with the embodiment for illustrating the method of manufacturing the common-mode choke coil.

Next, as shown in FIG. 5, two terminal electrodes 17A and 17B are bonded adhesive to flange 14 of magnetic core 11 with the adhesive. When the metal sheet is punched to form lead frame 15, a portion of the metal sheet to be punched is punched to have shapes of terminal electrodes 17A and 17B to be utilized as terminal electrodes 17A and 17B. This configuration reduces a material loss of the metal sheet. Then, similarly, terminal electrodes 17A and 17B are tentatively fixed onto flange 14 by heating at a temperature of about 150° C. for about 1 minute.

Figure 6:
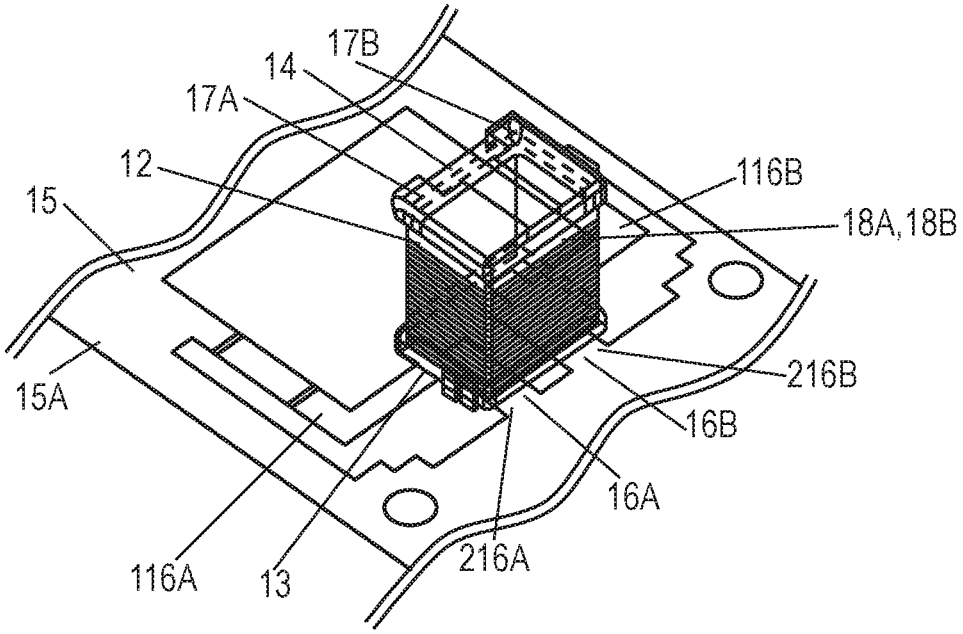
FIG. 6 is a perspective view of the common-mode choke coil in accordance with the embodiment for illustrating the method of manufacturing the common-mode choke coil.

Then, as shown in FIG. 6, a pair of insulation-coated conductive wires 18A and 18B are wound about winding core 12 of magnetic core 11. Ends 118A and 218A of insulation-coated conductive wire 18A are connected to terminal electrodes 16A and 16B, respectively. Ends 118B and 218B (see FIG. 1B) of insulation-coated conductive wire 18B are connected to terminal electrodes 17A and 17B, respectively. While the pair of insulation-coated conductive wires 18A and 18B are wound about winding core 12, magnetic core 11 shown in FIG. 2 is connected to lead frame 15 at three sides 113A, 113C, and 113D of outer peripheral edge 113P of surface 113 of flange 13 that are not on a single straight line, thereby allowing insulation-coated conductive wires 18A and 18B to be reliably wound about winding core 12.

Figure 7:
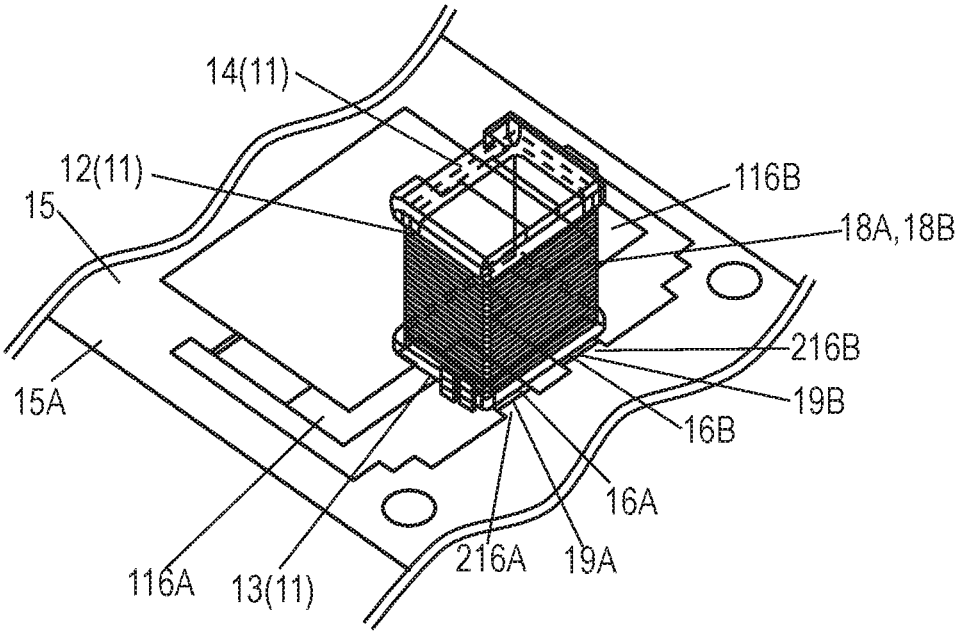
FIG. 7 is a perspective view of the common-mode choke coil in accordance with the embodiment for illustrating the method of manufacturing the common-mode choke coil.

Next, as shown in FIG. 7, portions 216A and 216B of lead frame 15 connected to terminal electrodes 16A and 16B are cut at cut positions 19A and 19B. Portions 216A and 216B of lead frame 15 are cut such that terminal electrodes 16A and 16B protrude from end surface 413 (see FIG. 2) of flange 13. In accordance with the embodiment, terminal electrodes 16A and 16B protrude from end surface 413 of flange 13 by about 0.1 mm.

Figure 8:
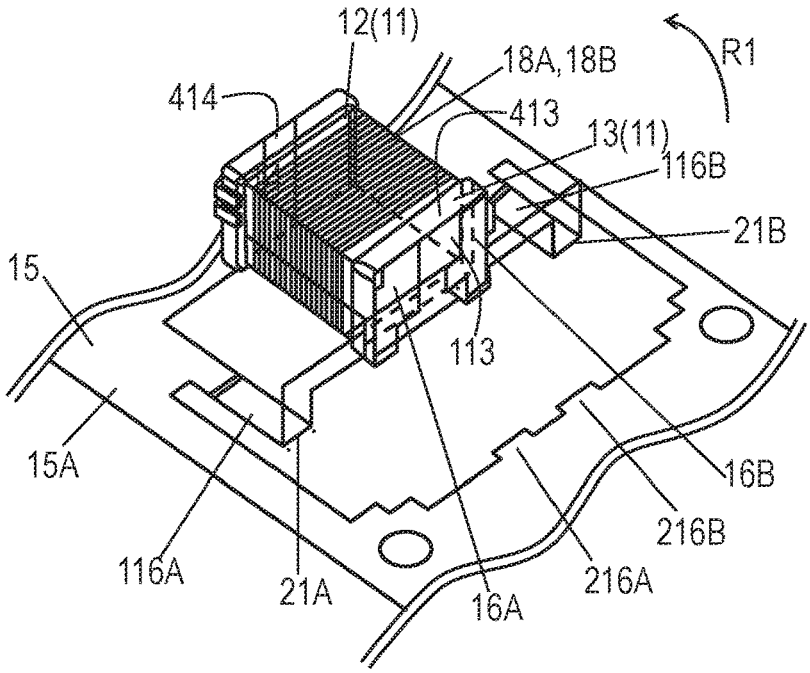
FIG. 8 is a perspective view of the common-mode choke coil in accordance with the embodiment for illustrating the method of manufacturing the common-mode choke coil.

Next, as shown in FIG. 8, lead frame 15 is bent at bent positions 21A and 21B of portions 116A and 116B so as to rotate magnetic core 11 fixed onto lead frame 15 by 90 degrees with respect to lead frame 15 in predetermined rotation direction R1. Here, the rotation by 90 degrees is not necessarily mean a rotation exactly by 90 degrees. This means that plane P1001 (see FIG. 1A) including end surfaces 413 and 414 of flanges 13 and 14 becomes almost horizontal as a result of the rotation.

Figure 9:
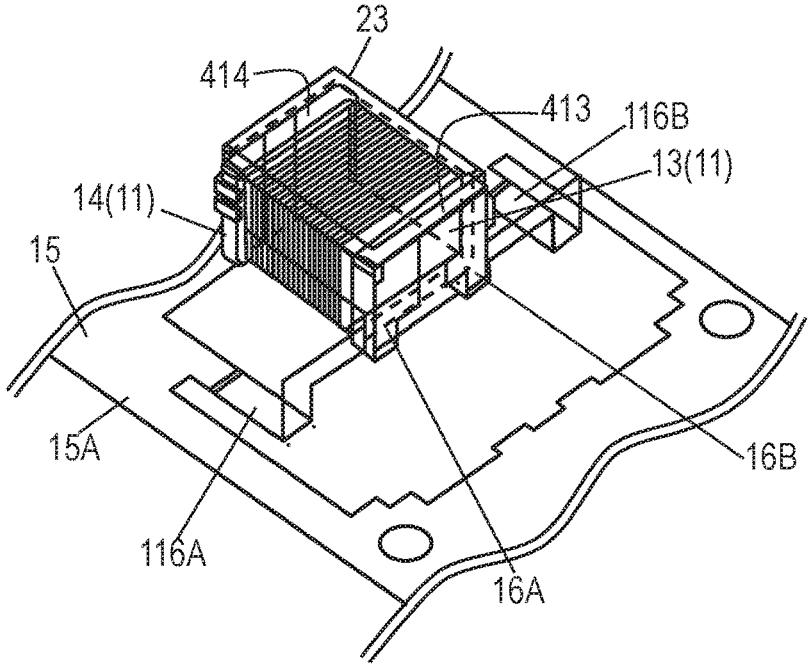
FIG. 9 is a perspective view of the common-mode choke coil in accordance with the embodiment for illustrating the method of manufacturing the common-mode choke coil.

Next, as shown in FIG. 9, adhesive is applied to end surfaces 413 and 414 of flanges 13 and 14, and magnetic plate 23 is attached and heated at about a temperature of 150° C. for about 1 minute to tentatively fix magnetic plate 23. Since terminal electrodes 16A and 16B protrude from end surface 413 of flange 13 by about 0.1 mm, magnetic plate 23 is easily positioned with respect to magnetic core 11. In this case, terminal electrodes 17A and 17B (see FIG. 5) preferably do not protrude from end surface 414 of flange 14. This configuration allows magnetic plate 23 to be easily aligned even though the size of magnetic plate 23 varies. End surfaces 413 and 414 of flanges 13 and 14 thus function as bonding surfaces to be bonded onto magnetic plate 23 with adhesive. FIG. 1A shows adhesives 413A and 414A applied to end surfaces 413 and 414 (bonding surfaces) of flanges 13 and 14 of magnetic core 11 and adhering to magnetic plate 23. Adhesive 413A reaches respective portions of terminal electrodes 16A and 16B protruding from plane P1001 including end surface 413 of flange 13. This configuration further increase the bonding strength between magnetic core 11 and magnetic plate 23.

Figure 10:
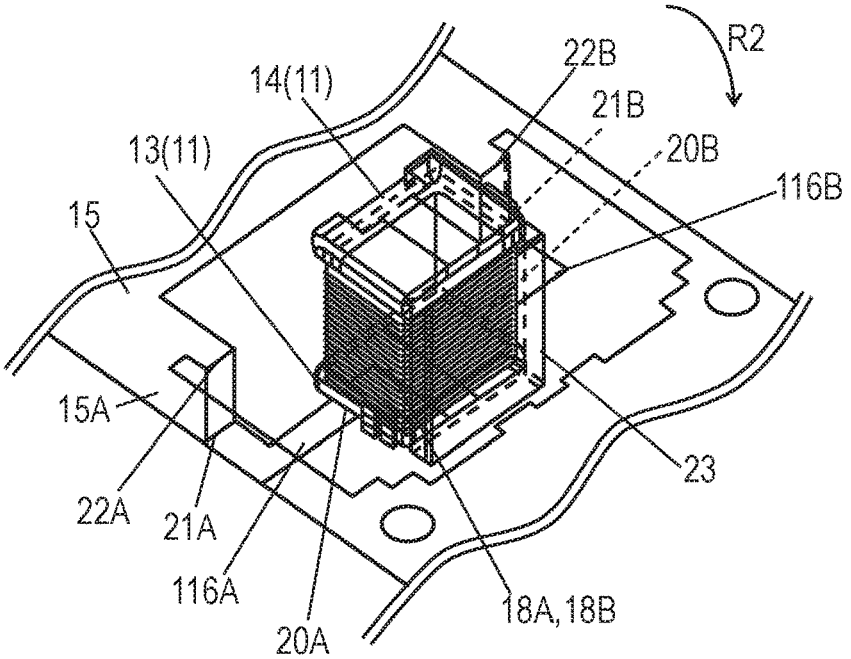
FIG. 10 is a perspective view illustrating the method for manufacturing the common-mode choke coil in accordance with the exemplary embodiment.

Next, as shown in FIG. 10, magnetic core 11 fixed onto lead frame 15 is rotated back by 90 degrees with respect to lead frame 15. More specifically, lead frame 15 is bent at bent positions 22A and 22B of portions 116A and 116B of lead frame 15 so as to rotate magnetic core 11 in rotation direction R2 opposite to rotation direction R1.

Next, lead frame 15 having the hoop shape is cut by predetermined lengths, stored in a stocker, and heated at a temperature of about 150° C. for about 30 minutes to cure the adhesive tentatively fixing terminal electrodes 16A, 16B, 17A, and 17B onto magnetic core 11.

Next, as shown in FIG. 10, portions 116A and 116B of lead frame 15 connected to terminal electrodes 16A and 16B are cut at cut positions 20A and 20B to provide individual pieces of common-mode choke coil 1001. As shown in FIG. 10, since lead frame 15 is bent at bent positions 22A and 22B on portions 116A and 116B of lead frame 15 so as to rotate magnetic core 11 in rotation direction R2, portions 116A and 116B are easily cut at cut positions 20A and 20B in a direction same as the cutting direction of lead frame 15 at cut positions 19A and 19B (see FIG. 7) of lead frame 15.

In the method of manufacturing common-mode choke coil disclosed in PTL1, the insulation-coated conductive wire is wound while only the bottom surface of one flange is bonded to the lead frame. Therefore, the magnetic core are movable, and prevents the wire from being wound reliably, resulting in unstable electrical performance. As the diameter of the insulation-coated conductive wire is larger in order to reduce a direct-current resistance, the wire is accordingly prevented from being wound reliably.

In the method of manufacturing common-mode choke coil 1001 in accordance with the embodiment, as shown in FIG. 2, magnetic core 11 is bonded to lead frame 15 shown in FIG. 6 at three sides 113A, 113C, and 113D of surface 113 of flange 13 that are not on a single straight line, thereby allowing insulation-coated conductive wires 18A and 18B to be reliably wound about winding core 12. Accordingly, common-mode choke coil 1001 having stable electrical performance can be manufactured efficiently.

Figure 11:
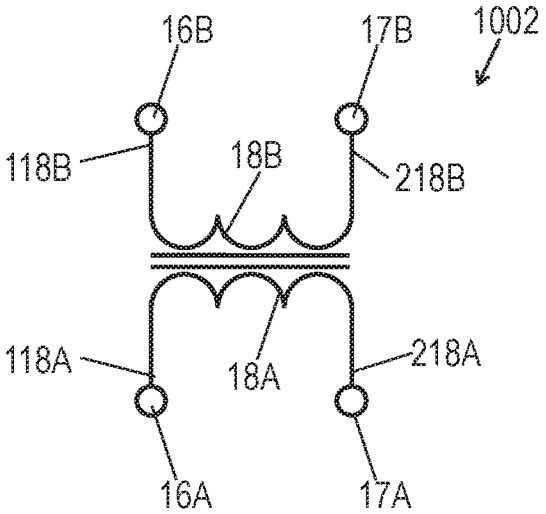
FIG. 11 is a circuit diagram of another common-mode choke coil in accordance with the embodiment.

FIG. 11 is a circuit diagram of another common-mode choke coil 1002 in accordance with the embodiment. In FIG. 11, components identical to those of common-mode choke coil 1001 shown in FIGS. 1A to 10 are denoted by the same reference numerals. Common-mode choke coil 1002 in FIG. 11 is different from common-mode choke coil 1001 shown in FIGS. 1A to 10 in connection between insulation-coated conductive wire 18A and terminal electrodes 16A, 16B, 17A, and 17B. More specifically, in common-mode choke coil 1002 shown in FIG. 11, one end 118A of insulation-coated conductive wire 18A is connected to terminal electrode 16A, and another end 218A of insulation-coated conductive wire 18A is connected to terminal electrode 17A. One end 118B of insulation-coated conductive wire 18B is connected to terminal electrode 16B, and another end 218B of insulation-coated conductive wire 18B is connected to terminal electrode 17B. Insulation-coated conductive wires 18A and 18B are magnetically coupled to each other. Common-mode choke coil 1002 shown in FIG. 11 has stable electrical characteristics as well as common-mode choke coil 1001 shown in FIGS. 1A to 10.

As described above, in common-mode choke coil 1001 in accordance with the embodiment, insulation-coated conductive wire 18A is connected to terminal electrode 16A and one terminal electrode 16B of terminal electrodes 16B and 17A, and is connected to none of terminal electrode 17B and another terminal electrode 17A of terminal electrodes 16B and 17A. Insulation-coated conductive wire 18B is connected to terminal electrode 17B and another terminal electrode 17A of terminal electrode 16B and 17A and terminal electrode 17B, and is connected to none of terminal electrode 16A and one terminal electrode 16B of terminal electrodes 16B and 17A.

In common-mode choke coil 1002 in accordance with the embodiment, insulation-coated conductive wire 18A is connected to terminal electrode 16A and one terminal electrode 17A of terminal electrodes 16B and 17A, and is connected to none of terminal electrode 17B and another terminal electrode 16B of terminal electrodes 16B and 17A. Insulation-coated conductive wire 18B is connected to terminal electrode 17B and another terminal electrode 16B of terminal electrodes 16B and 17A, and is connected to none of terminal electrode 16A and one terminal electrode 17A of terminal electrodes 16B and 17A.

REFERENCE MARKS IN THE DRAWINGS

11 magnetic core
12 winding core
13 flange (first flange)
14 flange (second flange)
15 lead frame
16A terminal electrode (first terminal electrode)
16B terminal electrode (second terminal electrode)
17A terminal electrode (third terminal electrode)
17B terminal electrode (fourth terminal electrode)
18A insulation-coated conductive wire (first insulation-coated conductive wire)
18B insulation-coated conductive wire (first insulation-coated conductive wire)
19A, 19B cut position
20A, 20B cut position
21A, 21B bent position
22A, 22B bent position
23 magnetic plate

The invention claimed is:

1. A method for manufacturing a common-mode choke coil, comprising the steps of:

preparing a magnetic core including a winding core, a first flange, and a second flange, the winding core having a first end and a second end opposite to the first end, the first flange being connected to the first end of the winding core, the second flange being connected to the second end of the winding core;

preparing a lead frame connected to first and second terminal electrodes;

bonding the first flange of the magnetic core to the first and second terminal electrodes while the first and second terminal electrodes are connected to the lead frame;

bonding third and fourth terminal electrodes to the second flange;

winding first and second insulation-coated conductive wires about the winding core;

connecting the first and second insulation-coated conductive wires to the first and second terminal electrodes and the third and fourth terminal electrodes;

bending the lead frame so as to rotate the magnetic core by 90 degrees with respect to the lead frame in a predetermined rotation direction while the first and second terminal electrodes are connected to the lead frame and bonded to the first flange;

bonding a magnetic plate to the magnetic core; and removing the magnetic core from the lead frame by removing the first and second terminal electrodes from the lead frame while the first flange of the magnetic core is bonded to the first and second terminal electrodes.

2. The method of claim 1, wherein said bonding the magnetic plate to the magnetic core comprises bonding the magnetic plate to a bonding surface of the first flange of the magnetic core, and wherein said bonding the first flange of the magnetic core to the first and second terminal electrodes comprises bonding the first flange of the magnetic core to the first and second terminal electrodes such that the first and second terminal electrodes protrude from a plane including the bonding surface of the first flange while the first and second terminal electrodes are connected to the lead frame.

3. The method of claim 2, wherein said bonding the magnetic plate to the magnetic core further comprises bonding the magnetic plate to a bonding surface of the second flange of the magnetic core, and wherein said bonding the third and fourth terminal electrodes to the second flange comprises bonding the third and fourth terminal electrodes to the second flange such that the third and fourth terminal electrodes do not protrude from a plane including the bonding surface of the second flange.

4. The method of claim 3, wherein said bonding the magnetic plate to the magnetic core comprises bonding the magnetic plate to the bonding surface of the first flange and the bonding surface of the second flange of the magnetic core while positioning the magnetic plate by causing the magnetic plate to contact a portion of the first terminal electrode protruding from the plane.

5. The method of claim 2, wherein said bonding the magnetic plate to the magnetic core comprises bonding the magnetic plate to the bonding surface of the first flange of the magnetic core while positioning the magnetic plate by causing the magnetic plate to contact a portion of the first terminal electrode protruding from the plane.

6. The method of claim 1, further comprising bending the lead frame so as to rotate the magnetic core by 90 degrees with respect to the lead frame in a rotation direction opposite to the predetermined rotation direction after said bonding the magnetic plate to the magnetic core.

7. The method of claim 1, wherein said removing the first and second terminal electrodes from the lead frame is executed after said bonding the third and fourth terminal electrodes to the second flange, said winding the first and second insulation-coated conductive wires about the winding core, said connecting the first and second insulation-coated conductive wires to the first and second terminal electrodes and the third and fourth terminal electrodes, said bending the lead frame, and said bonding the magnetic plate to the magnetic core.

8. The method of claim 1, wherein said bonding the first flange of the magnetic core to the first and second terminal electrodes comprises bonding a surface of the first flange of the magnetic core to the first and second terminal electrodes while the first and second terminal electrodes are connected to the lead frame, and wherein said winding the first and second insulation-coated conductive wires about the winding core comprises winding the first and second insulation-coated conductive wires about the winding core while the magnetic core is bonded to the lead frame at at least three parts of an outer peripheral edge of the surface of the first flange of the magnetic core, the at least three parts being not on a straight line.

9. The method of claim 1, wherein said connecting the first and second insulation-coated conductive wires to the first and second terminal electrodes and the third and fourth terminal electrodes comprises connecting the first and second insulation-coated conductive wires to the first and second terminal electrodes and the third and fourth terminal electrodes such that:

the first insulation-coated conductive wire is connected to the first terminal electrode and one terminal electrode of the second and third terminal electrodes, and is connected to none of the fourth terminal electrode and another terminal electrode of the second and third electrodes, and the second insulation-coated conductive wire is connected to the fourth terminal electrode and the another terminal electrode of the second and third terminal electrodes, and is connected to none of the first terminal electrode and the one terminal electrode of the second and third terminal electrodes.

* * * * *